US008517330B1

(12) United States Patent
Joyce

(10) Patent No.: US 8,517,330 B1
(45) Date of Patent: Aug. 27, 2013

(54) ERGONOMIC CLIPBOARD

(76) Inventor: Jared L. Joyce, Bozeman, MT (US)

( * ) Notice: Subject to any disclaimer, the term of this patent is extended or adjusted under 35 U.S.C. 154(b) by 1080 days.

(21) Appl. No.: 11/039,723

(22) Filed: Jan. 18, 2005

(51) Int. Cl.
*A47B 97/04* (2006.01)

(52) U.S. Cl.
USPC ..... 248/451; 248/452; 24/67.3

(58) Field of Classification Search
USPC ..... 248/451, 441.1, 452, 447; 281/45, 281/44; 24/67 R, 67.3, 67.5, 67.7, 67.11
See application file for complete search history.

(56) References Cited

U.S. PATENT DOCUMENTS

| | | | | | |
|---|---|---|---|---|---|
| 1,894,559 | A | | 1/1933 | Fisher | |
| 2,284,501 | A | | 5/1942 | Welch | |
| 2,516,239 | A | | 7/1950 | Moss | |
| D172,363 | S | | 6/1954 | Rosenbaum | |
| 2,881,009 | A | * | 4/1959 | Delaney | 108/43 |
| D185,285 | S | * | 5/1959 | Howard | D19/88 |
| D185,286 | S | | 5/1959 | Howard | |
| 3,013,818 | A | | 12/1961 | Plotzker et al. | |
| D221,360 | S | | 8/1971 | Prince | |
| D243,688 | S | * | 3/1977 | Keyko et al. | D19/88 |
| 4,586,730 | A | | 5/1986 | Shulyak | |
| 4,750,657 | A | | 6/1988 | King | |
| D349,731 | S | * | 8/1994 | Leveen et al. | D19/88 |
| D403,019 | S | | 12/1998 | Bedol et al. | |
| D442,631 | S | * | 5/2001 | Pfanner et al. | D19/27 |
| D450,090 | S | | 11/2001 | Cheria et al. | |
| 6,637,774 | B2 | | 10/2003 | Gaska | |
| D490,472 | S | | 5/2004 | Nuttall et al. | |
| D495,369 | S | | 8/2004 | Holland | |
| 6,866,516 | B2 | * | 3/2005 | Smith et al. | 434/408 |
| D520,561 | S | * | 5/2006 | Rolion et al. | D19/52 |

* cited by examiner

*Primary Examiner* — Todd M. Epps
(74) *Attorney, Agent, or Firm* — Robert M. Hunter

(57) ABSTRACT

An ergonomic clipboard that can be easily grasped by persons of various body shapes and sizes. Preferably, the ergonomic clipboard comprises a writing board including a surface having a clamp attached to it, a top edge, a first side edge sharing a first corner with said top edge and having two recesses, each of which recesses being configured to engage with the crook of an arm of a user, a second side edge sharing a second corner with said top edge and that is opposite said first side edge, said second side edge having a protrusion and an adjacent notch that are configured to be graspable by the fingers of the same arm of the user, and a bottom edge sharing a third corner with said first side edge and a fourth corner with said second side edge.

13 Claims, 2 Drawing Sheets

ERGONOMIC CLIPBOARD

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

This invention relates to ergonomic clipboards. In particular, the invention relates to a clipboard that can be easily grasped by users of various sizes.

Clipboards have been used as writing surfaces for decades. Most background art clipboards are rectangular in shape and, hence, awkward to grasp. The natural configuration into which a human arm bends cannot be attained when such clipboards are used.

The background art is characterized by U.S. Pat. Nos. 1,894,559; 2,284,501; 2,516,239; 2,881,009; 3013,818; 4,586,730; 4,750,657; 6,637,774; D172,363; D1185,285; D221,360; D243,688; D349,731; D403,019; D450,090; D490,471; and D495,369; the disclosures of which patents are incorporated by reference as if fully set forth herein.

Fisher in U.S. Pat. No. 1,894,559 discloses a body fitting writing board. This invention is limited in that its base is curved to fit the abdominal front and side of the user.

Welch in U.S. Pat. No. 2,284,501 discloses a time study board. This invention is limited in that a lower or bottom edge is required to slant upwardly a trifle toward ip.a shorter left edge 5 so that the lower or bottom edge engages with the body of the user, desirably above the hip. Moreover, the upper or top edge 8 of the board is provided with a three-sided projection 10 which constitutes a handle.

Moss in U.S. Pat. No. 2,516,239 discloses a clip board. This invention is limited in that it provides an arm 11 having a single curve 13 such as to fit comfortably into the inside bend of the arm at the elbow of a user and another curve 12 that conforms to the stomach curve above the waist of the user and two readily grasped extensions diagonally opposite arm 11.

Delaney in U.S. Pat. No. 2,881,009 discloses a writing board. This invention is limited in that the lower left hand corner of the board is concavely curved as at 12 to provide a surface for fitting the lower portion of the chest of a user. On a side adjacent to curve 12, two projecting portions 13 and 14 are formed to provide a single recess 15 there between. Single recess 15 is shaped to partially encircle the user's arm. Moreover, diagonally across the board from curved corner 12 a flat extension 16 is provided to hold two stop watches.

Plotzker et al. in U.S. Pat. No. 3,013,818 disclose a braceable clip board. This invention is limited in that it includes a board having an upper work surface 10 and a lower work surface 12 with a single elbow engaging corner portion 22 having an edge 36 and a grip element 20 attached to lower work surface 12. The elbow contacting portion of the board 48 may have a curved outer edge 50 of concave contour that is concealed by molded foam rubber or soft plastic molding 52 providing padding for engagement of this portion of the board against the crook of the elbow of the user.

King in U.S. Pat. No. 4,750,657 disclosed a body-supported clip board. This invention is limited in that the thickened portion of the board between F and G is curved to contact the user's midsection. Moreover, straps are required.

A review of the background art reveals that technical problems still exist in the art. What is needed is a clipboard that satisfies the writing needs of people of all shapes and sizes, while achieving a high level of aesthetic appeal.

BRIEF SUMMARY OF THE INVENTION

The purpose of the invention is to provide a writing board that can be easily grasped by persons of various body shapes and sizes. One advantage of a preferred embodiment of the invention is that it is usable by women and men. Another advantage of a preferred embodiment of the invention is that it is usable by right-handed and left-handed users. Another advantage of a preferred embodiment of the invention is that it comprises portions that abut or engage with parts of the user's anatomy rendering the invention more stable when used. Another advantage is that the invention need not be rested on the torso (e.g., chest or abdomen) of the user to be stable.

The invention is an apparatus that provides an easily grasped writing surface and that is preferably named Ergo-CB™. In a preferred embodiment, the invention is an apparatus that comprises: a substantially rectangular body portion having a clip affixed thereto; a first side portion that is attached to said body portion, said first side portion having a first lower inner-elbow accepting recess, a first upper inner-elbow accepting recess, a first lower graspable protrusion and a first upper graspable protrusion; a second side portion that is attached to said body portion, said second side portion having a second lower elbow accepting recess, a second upper elbow accepting recess, a second lower graspable protrusion and a second upper graspable protrusion; a top portion that is attached to said body portion, said top portion having a first thumb accepting recess and a second thumb accepting recess; and a bottom portion that is attached to said body portion, said bottom portion having two rounded corners.

In another preferred embodiment, the invention is not symmetrical. In this embodiment, the invention is an apparatus that comprises: a body portion having a clip affixed thereto; a first side portion that is attached to said body portion, said first side portion having a lower inner-elbow accepting recess and a upper inner-elbow accepting recess; a second side portion that is attached to said body portion, said second side portion having a lower graspable protrusions and an upper graspable protrusion; a top portion that is attached to said body portion, said top portion having a thumb accepting recess; and a bottom portion that is attached to said body portion, said bottom portion having corners.

In another preferred embodiment, the invention is an apparatus that comprises: a writing board including a surface of said writing board having a clamp attached to it, a top edge of said writing board, a first side edge of said writing board sharing a first corner with said top edge, said first side edge having two recesses, each of which recesses being configured to engage with the crook of an arm of a user, a second side edge of said writing board sharing a second corner with said top edge and that is opposite said first side edge, said second side edge having a protrusion and an adjacent notch that are configured to be graspable by the fingers of the same arm of the user, and a bottom edge of said writing board, said bottom edge sharing a third corner with said first side edge and a fourth corner with said second side edge.

In use, the invention is preferably operated by clipping a piece of paper to the clipboard, placing an elbow accepting recess on one side of the clipboard in the crook of the arm of a user and grasping either a graspable protrusion or an upper corner on the other side of the clipboard with the fingers of the same arm. In preferred embodiments of the invention, the clipboard may be held in either arm and need not be rested on the torso of the user to be stable.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 2:
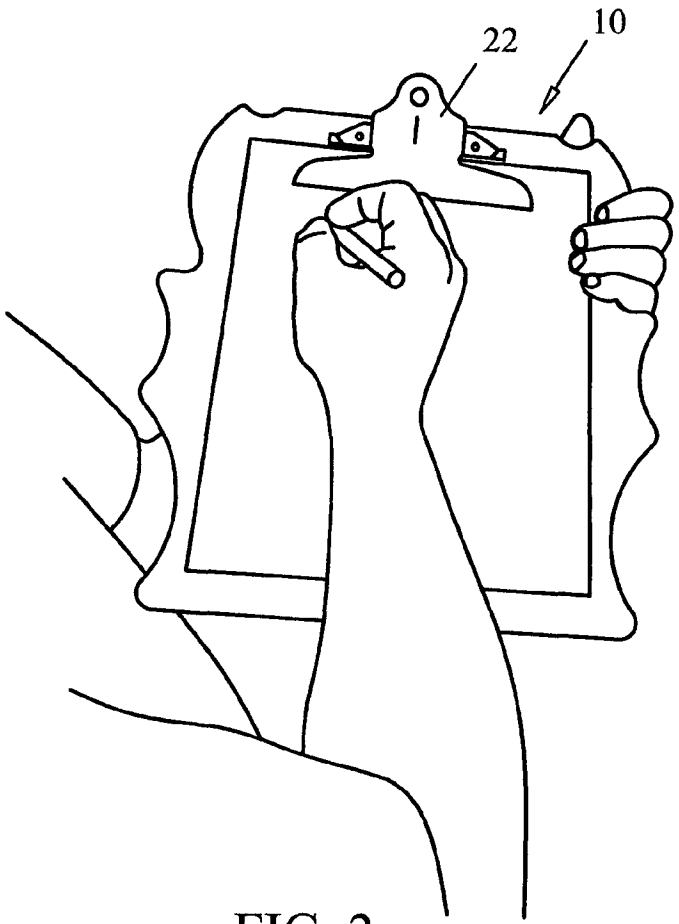
FIG. 2 is a perspective view showing a user holding a preferred embodiment of the invention.

The following reference numerals are used to indicate the parts and environment of the invention on the drawings:

10 clipboard, writing board
12 body portion
14 first side portion
16 second side portion
18 top portion
20 bottom portion
22 clip, clamp
24 first lower inner-elbow accepting recess
25 first intermediate arc
26 first upper inner-elbow accepting recess
28 first lower graspable protrusion
29 first lower notch
30 first upper graspable protrusion
32 second lower inner-elbow accepting recess
33 second intermediate arc
34 second upper inner-elbow accepting recess
36 second lower graspable protrusion
38 second upper graspable protrusion
40 first thumb accepting recess
42 second thumb accepting recess
44 first rounded corner
46 second rounded corner
48 center
50 top inside width
52 top outside width
54 maximum width
56 first top inside arc
60 first top outside arc
62 first lower arc
64 bottom inside width
66 first bottom arc
67 bottom outside width
68 second bottom arc
70 second top inside arc
72 second top outside arc

DETAILED DESCRIPTION OF THE INVENTION

Figure 1:
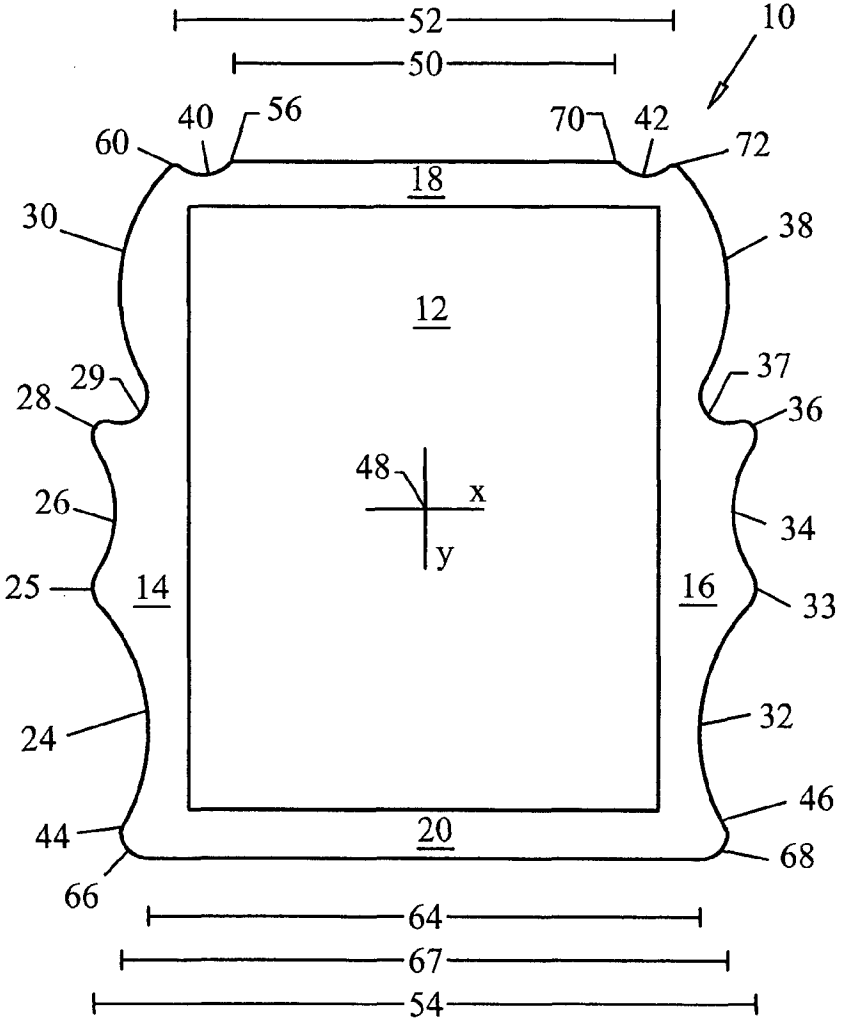
FIG. 1 is a plan view of a preferred embodiment of the invention, showing preferred radii for selected features.

Referring to FIG. 1, a preferred embodiment of clipboard 10 is presented. In this embodiment, clipboard 10 apparatus comprises: substantially rectangular body portion 12, first side portion 14, second side portion 16, top portion 18 and bottom portion 20. Clip 22 is affixed to substantially rectangular body portion 20 adjacent to its upper end. Body portion 12 is preferably of a suitable stiffness and of such dimensions as to hold one or more sheets of legal or smaller sized writing paper. Clip 22 may be of any suitable design to hold the sheets of writing paper. Examples of appropriate clips are those disclosed in U.S. Pat. Nos. 2,516,239 and 2,881,009, which patents were incorporated by reference above.

First (e.g., left) side portion 14 is attached to body portion 12 and is preferably integral to it. First side portion 14 is configured to provide first lower inner-elbow accepting recess 24, first upper inner-elbow accepting recess 26, first lower graspable protrusion 28 and first upper graspable protrusion 30. First lower inner-elbow accepting recess 24 and first upper inner-elbow accepting recess 26 are configured to conform to the crook of the left arm of users of different sizes (larger and smaller). First lower graspable protrusion 28 or first upper graspable protrusion 30 are graspable by the fingers of the right hand of a user and are preferably separated by first lower notch 29 that is capable of accepting the bottom of the palm of the right hand of the larger user.

Second (e.g., right) side portion 16 is attached to body portion 12 and is preferably integral to it. Second side portion 16 is configured to provide second lower inner-elbow accepting recess 32, second upper inner-elbow accepting recess 34, first lower graspable protrusion 36 and second upper graspable protrusion 38. Second lower inner-elbow accepting recess 32 and second upper inner-elbow accepting recess 34 are configured to conform to the crook of the right arm of users of different sizes. Second lower graspable protrusion 36 or second upper graspable protrusion 38 are graspable by the fingers of the left hand of the user and are preferably separated by second lower notch 37 that is capable of accepting the bottom of the palm of the left hand of the larger user.

Top portion 18 is attached to body portion 12 and is preferably integral to it. Top portion 18 is configured to provide first thumb accepting recess 40 and second thumb accepting recess 42. Thumb accepting recesses 40 and 42 are configured to accept the thumb of the right hand or the left hand of a larger user, respectively. Bottom portion 20 is attached to body portion 12 and is preferably integral to it. Preferably, bottom portion 20 has two rounded corners, first rounded corner 44 and second rounded corner 46.

Referring to again to FIG. 1, the features of clipboard 10 are shown to have preferred dimensions. While the following dimensions are preferred, the applicant envisions that any individual dimension or all of the disclosed dimensions are approximate and can vary by plus or minus fifty percent from the preferred dimension. On the X (side to side) axis, the terms "inside" and "outside" are relative to center 48 of clipboard 10, with "inside" meaning closer to center 48 and "outside" meaning farther from center 48. Likewise, the terms "concave" and "convex" are relative to center 48 of clipboard 10, with concave arcs generally arcing inward toward center 48 and convex arcs generally arcing outward away from center 48. On the Y (up and down) axis, the terms "top" and "bottom" relative to the top of clipboard 10 which is the elevation of top outside width 52 and the bottom of clipboard 10 which is the elevation of bottom outside width 27. The "top" of any arc means closer to the top of clipboard 10 and the "bottom" of any arc means closer to the bottom of clipboard 10.

In this embodiment, top inside width 50 of the top of clipboard 10 from the inside of the left side concave arc (first top inside arc 56) to the inside of the corresponding concave arc on the right side (second top inside arc 70) is preferably 6.55 inches. Top outside width 52 of clipboard 10 from the outside of the concave arc on the left side (first top outside arc 60) to the outside of the concave arc on the right side (second top outside arc 72) is preferably 9.38 inches. Maximum width 54 of clipboard 10 from the farthest-reaching convex arc on either side is preferably 12.01 inches. Bottom inside width 64 of clipboard 10 from the inside of the convex arc on the left side (first bottom arc 66) to the inside of the convex arc on the right side (second bottom arc 68) is preferably 10 inches. Bottom outside width 67 of clipboard 10 from the outside of the convex arc on the left side that forms first rounded corner 44 to the outside of the convex arc on the right side that forms second rounded corner 46 is preferably 10.97 inches.

The following preferred dimensions characterize clipboard 10 in a counterclockwise manner from the top to the bottom of the left side. At the top of clipboard 10, first top inside arc 56 is preferably located at the inside of first thumb accepting recess 40. First top inside arc 56 is preferably convex and has a radius of 0.13 inches. First thumb accepting recess 40 is preferably formed by a concave arc with a length of 1.5 inches and a radius of 0.75 inch. First top outside arc 60 is preferably located at the outside of first thumb accepting recess 40 and at the top of first upper graspable protrusion 30 and is preferably convex with a radius of 0.13 inch. Measured along the Y-axis, the highest point of first top outside arc 60 is preferably 0.07 inch below the highest point of first top inside arc 56.

First upper graspable protrusion 30 and is preferably formed by a convex arc with a length of 4.10 inches and a radius of 3.52 inches. First lower notch 29 at the bottom of first graspable protrusion 30 is preferably formed by a concave arc with a length of 1 inch when measured from the bottom of the arc forming first upper graspable protrusion 30 and a radius of 0.5 inch.

First upper graspable protrusion 28 is preferably formed by a convex arc with a length of 0.41 inch when measured from the bottom of first lower notch 29 and a radius of 0.25 inch. First upper inner-elbow accepting recess 26 is preferably formed by a concave arc with a length of 2.76 inches and a radius of 2 inches.

The bottom of first upper inner-elbow accepting recess 26 and the top of first lower inner-elbow accepting recess 24 is preferably formed by first intermediate arc 25 that is a convex arc with a length of 0.99 inches when measured from the top of first lower inner-elbow accepting recess 24 and a radius of 0.5 inch. First lower inner-elbow accepting recess 24 is preferably formed by a concave arc with a length of 4.43 inches and a radius of 3.35 inches.

The bottom of first lower inner-elbow accepting recess 24 is preferably formed by a convex arc with a length of 0.44 inch when measured from the top of first rounded corner 44 and a radius of 0.25 inch. Rounded corner 44 is formed by first bottom arc 66 which is preferably a convex arc with a length of 0.49 inch and a radius of 0.5 inch.

The following preferred dimensions characterize clipboard 10 in a clockwise manner from the top to the bottom of the right side. At the top of clipboard 10, second top inside arc 70 is preferably located at the inside of second thumb accepting recess 42. Second top inside arc 70 is preferably convex arc and has a radius of 0.13 inches. Second thumb accepting recess 42 is preferably formed by a concave arc with a length of 1.5 inches and a radius of 0.75 inch. Second top outside arc 72 is located preferably at the outside of second thumb accepting recess 42 and at the top of second upper graspable protrusion 38 and is preferably convex with a radius of 0.13 inch. Measured along the Y-axis, the highest point of second top outside arc 72 is preferably 0.07 inch above the highest point of second inside top arc 70.

Second upper graspable protrusion 38 and is preferably formed by a convex arc with a length of 4.10 inches and a radius of 3.52 inches. Second lower notch 37 at the bottom of second graspable protrusion 38 is preferably formed by a concave arc with a length of 1 inch when measured from the bottom of the arc forming first upper graspable protrusion 38 and a radius of 0.5 inch.

Second upper graspable protrusion 36 is preferably formed by a convex arc with a length of 0.41 inch when measured from the bottom of second lower notch 37 and a radius of 0.25 inch. Second upper inner-elbow accepting recess 34 is preferably formed by a concave arc with a length of 2.76 inches and a radius of 2 inches.

The bottom of second upper inner-elbow accepting recess 34 and the top of second lower inner-elbow accepting recess 32 is preferably formed by second intermediate arc 33 which is a convex arc with a length of 0.99 inches when measured from the top of second lower inner-elbow accepting recess 32 and a radius of 0.5 inch. Second lower inner-elbow accepting recess 32 is preferably formed by a concave arc with a length of 4.43 inches and a radius of 3.35 inches.

The bottom of second lower inner-elbow accepting recess 32 is preferably formed by a convex arc with a length of 0.44 inch when measured from the top second rounded corner 46 and a radius of 0.25 inch. Rounded corner 46 is formed by second bottom arc 68 which is preferably a convex arc with a length of 0.49 inch and a radius of 0.5 inch.

Referring to FIG. 2, clipboard 10 is being grasped by a right-handed user of smaller size, in this case a women that is 5'0" in height. In this situation, first upper inner-elbow accepting recess 26 accepts the left inner-elbow (crook of the left arm) of the user and the fingers of the left hand of the user grasp second lower graspable protrusion 36.

Figure 3:
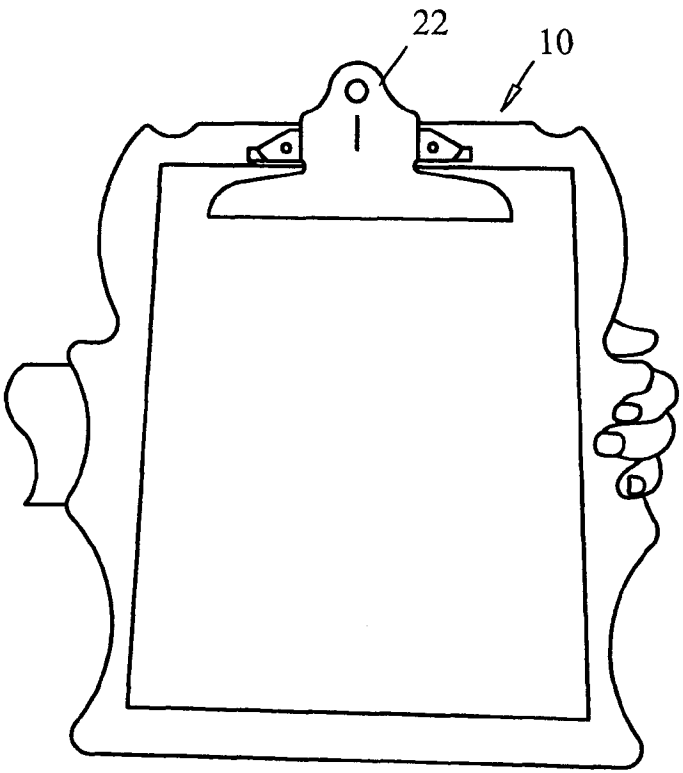
FIG. 3 is a perspective view showing another user holding a preferred embodiment of the invention.

Referring to FIG. 3, clipboard 10 is being grasped by a right-handed user of intermediate size, in this case a women that is 5'8" in height. In this situation, first lower inner-elbow accepting recess 24 accepts the left inner-elbow (crook of the left arm) of the user and the fingers of the left hand of the user grasp second lower graspable protrusion 36.

Figure 4:
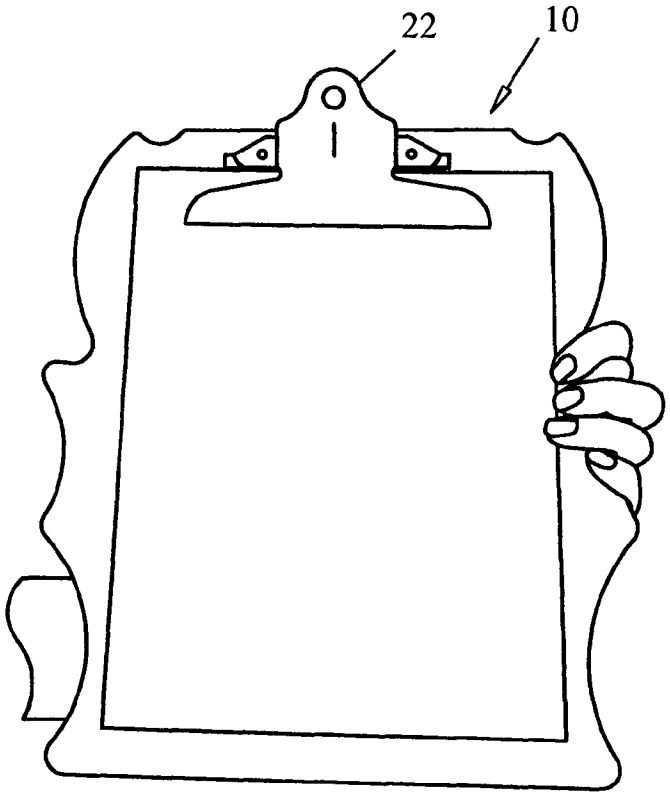
FIG. 4 is a perspective view showing yet another user holding a preferred embodiment of the invention.

Referring to FIG. 4, clipboard 10 is being grasped by a right-handed user of larger size, in this case a man that is 6'4" in height. In this situation, first lower inner-elbow accepting recess 24 accepts the left inner-elbow (crook of the left arm) of the user and the fingers of the left hand of the user grasp second upper graspable protrusion 38.

Operation of the invention involves securing one or more pieces of paper to clipboard 10 with clip 22 and holding clipboard 10 in one of the ways described above. Resting clipboard 10 on the torso of the user is not required.

Many variations of the invention will occur to those skilled in the art. Some variations include symmetrical configurations. Other variations call for asymmetrical configurations. All such variations are intended to be within the scope and spirit of the invention.

Although some embodiments are shown to include certain features, the applicant specifically contemplates that any feature disclosed herein may be used together or in combination with any other feature on any embodiment of the invention. It is also contemplated that any feature may be specifically excluded from any embodiment of the invention.

What is claimed is:

1. An apparatus comprising:

a substantially rectangular body portion having a spring-biased clip affixed thereto;

a first side portion that is attached to said body portion, said first side portion having a first lower inner-elbow accepting recess that is formed by a concave arc having a radius of about 3.35 inches, a first upper inner-elbow accepting recess that is formed by a concave arc having a radius of about 2 inches, a first lower graspable protrusion that is formed by a convex arc having a radius of about 0.25 inch and a first upper graspable protrusion that is formed by a convex arc having a radius of about 3.52 inches;

a second side portion that is attached to said body portion, said second side portion having a second lower inner-elbow accepting recess that is formed by a concave arc having a radius of about 3.35 inches, a second upper inner-elbow accepting recess that is formed by a concave arc having a radius of about 2 inches, a second lower graspable protrusion that is formed by a convex arc having a radius of about 0.25 inch and a second upper graspable protrusion that is formed by a convex arc having a radius of about 3.52 inches;

a top portion that is attached to said body portion, said top portion having a first thumb accepting recess that is disposed adjacent to said first upper graspable protrusion and a second thumb accepting recess that is disposed adjacent to said second upper graspable protrusion, each of said thumb accepting recesses being formed by a concave arc having a radius of about 0.75 inch; and a bottom portion that is attached to said body portion, said bottom portion having two rounded corners;

wherein said first thumb accepting recess is reachable by a user's thumb when said user is grasping said first upper graspable protrusion and said second thumb accepting recess is reachable by said user's thumb when said user is grasping said second upper graspable protrusion.

2. An apparatus comprising:

a substantially rectangular body portion having a clip affixed thereto;

a first side portion that is attached to said body portion, said first side portion having a first lower inner-elbow accepting recess, a first upper inner-elbow accepting recess, a first lower graspable protrusion and a first upper graspable protrusion;

a second side portion that is attached to said body portion, said second side portion having a second lower inner-elbow accepting recess, a second upper inner-elbow accepting recess, a second lower graspable protrusion and a second upper graspable protrusion;

a top portion that is attached to said body portion, said top portion having a first thumb accepting recess that is disposed adjacent to said first upper graspable protrusion and a second thumb accepting recess that is disposed adjacent to said second upper graspable protrusion; and a bottom portion that is attached to said body portion, said bottom portion having two rounded corners.

3. The apparatus of claim 2 wherein said each of said lower inner-elbow accepting recesses is formed by a concave arc having a radius of about 3.35 inches.

4. The apparatus of claim 2 wherein said each of said upper inner-elbow accepting recesses is formed by a concave arc having a radius of about 2 inches.

5. The apparatus of claim 2 wherein said each of said lower graspable protrusions is formed by a convex arc having a radius of about 0.25 inch.

6. The apparatus of claim 2 wherein said each of said upper graspable protrusions is formed by a convex arc having a radius of about 3.52 inches.

7. The apparatus of claim 2 wherein each of said thumb accepting recesses is formed by a concave arc having a radius of about 0.75 inch.

8. An apparatus comprising:

a body portion having a clip affixed thereto;

a first side portion that is attached to said body portion, said first side portion having a lower inner-elbow accepting recess and a upper inner-elbow accepting recess;

a second side portion that is attached to said body portion, said second side portion having a lower graspable protrusion and an upper graspable protrusion;

a top portion that is attached to said body portion, said top portion having a thumb accepting recess that is disposed adjacent to said upper graspable protrusion; and a bottom portion that is attached to said body portion, said bottom portion having corners.

9. The apparatus of claim 8 wherein said lower inner-elbow accepting recess is formed by a concave arc having a radius of about 3.35 inches.

10. The apparatus of claim 8 wherein said upper inner-elbow accepting recess is formed by a concave arc having a radius of about 2 inches.

11. The apparatus of claim 8 wherein said lower graspable protrusion is formed by a convex arc having a radius of about 0.25 inch.

12. The apparatus of claim 8 wherein said upper graspable protrusion is formed by a convex arc having a radius of about 3.52 inches.

13. The apparatus of claim 8 wherein said thumb accepting recess is formed by a concave arc having a radius of about 0.75 inch.

* * * * *